United States Patent [19]

Klein et al.

[11] 4,018,178

[45] Apr. 19, 1977

[54] METHOD OF MANUFACTURE OF A GATED CAN LID WITH SCORE AT UPPER SURFACE

[75] Inventors: Gerald B. Klein, Broomfield; Frank C. Lowe, Idaho Springs, both of Colo.

[73] Assignee: Gerald B. Klein, Broomfield, Colo.

[22] Filed: Oct. 24, 1975

[21] Appl. No.: 625,716

Related U.S. Application Data

[62] Division of Ser. No. 562,559, March 27, 1975, abandoned.

[52] U.S. Cl. ..... 113/121 C; 220/268

[51] Int. Cl.[2] ..... B21D 51/44

[58] Field of Search ..... 113/121 R, 121 A, 121 C; 220/268

[56] References Cited

UNITED STATES PATENTS

| | | | |
|---|---|---|---|
| 3,705,563 | 12/1972 | Elser | 113/121 C |
| 3,880,316 | 4/1975 | Martella | 220/268 |

*Primary Examiner*—Travis S. McGehee

*Attorney, Agent, or Firm*—Dennis O. Kraft

[57] ABSTRACT

A can lid includes a pushdown gate formed in a panel portion below a narrow, underfolded rim at the opening in the lid. The outline of the gate is a disruptible score cut in the panel portion underneath the rim. This structure is essentially the same as that disclosed in the Klein-Harper U.S. Pat. No. 3,334,775. However, the score cut defining the outline of the gate is at the upper surface of the panel portion instead of being at the undersurface. A method of drawing and folding the lid material permits the score line to be cut before the underfolded rim is formed over the score cut.

5 Claims, 10 Drawing Figures

METHOD OF MANUFACTURE OF A GATED CAN LID WITH SCORE AT UPPER SURFACE

This is a divisional, of application Ser. No. 562,559, filed Mar. 27, 1975, now abandoned.

The present invention relates to gated can lids of the type having a gate which may be opened by pushing the gate downwardly into the can, and more particularly to gated can lids wherein the gate is defined by a score line in the lid of the can and opening is effected by rupturing and/or tearing the score line when the gate is being pushed downwardly and into the can.

A flat surfaced can lid having a push-in gate, or tab, defined by a score line in the surface of the lid, was found to be undesirable because of the sharp, ragged edge formed about the opening when the gate was separated from the lid, could easily cut an individual's finger as he opened the gate and even cut his lips when drinking from the can. As a result, an improved type of a push-in gate for a can lid was invented and developed as disclosed in the U.S. Pat. No. 3,334,775 issued Aug. 8, 1967. This patent discloses a narrow, underfolded rim about the opening, or aperture, in the can lid with the gate being below this rim and being defined by a score line which underlies this rim.

This arrangement is easily manufactured by conventional drawing methods where the metal forming the can lid is first stretched to form a cup-like cavity and thereafter, the walls of the cup-like cavity are further stretched to form the intermediate underfolded rim and to enlarge the area of the lid portion forming the gate beneath the rim. As a final step, a score line is cut at the underside of this lid portion to define the gate, and this score line lies underneath the intermediate rim. Accordingly, whenever the gate is opened by pushing it into the can, the edge of the opening, or aperture, is the rounded edge of metal joining the lid and the intermediate rim and not the torn edge at the score line. The rounded edge at the opening, or aperture, eliminates the possibility of an individual cutting his finger in the opening.

In the manufacture of a gated can lid as disclosed in the U.S. Pat. No. 3,334,775, it becomes necessary to subsequently redo or repair the protective coating which is always provided at the underside of the can lid because the score line will rupture the coating as it is cut. It is also necessary to use very precise dies and careful operations to cut the score line to form this underfolded gate. Too deep a cut can cause the score line to accidentally rupture and too shallow a cut will require an excessive pushing force to tear the score line. Cutting against the underfolded rim, that is, cutting against three thicknesses of metal, renders this operation especially difficult.

Thus, it was postulated that if a score line, outlining the gate, could be cut at the upper surface of the can lid instead of at the undersurface of the underfolded gate, the result would be more desirable for several reasons. In the first place, this would eliminate a need to repair the protective coating at the inner side of the can lid. Also, since the score line could be cut with the dies operating on a single thickness of the metal, rather than three thicknesses, a much better control of the depth of the score line would be possible. Finally, should a small portion of the score line be cut or lanced through the lid to permit an easy commencement of tearing of the score line when the lid is pushed downwardly, a sealant to prevent a leak could be applied in a more effective manner in the score line at the upper surface of the lid rather than into a score line at the undersurface thereof.

However, when considering conventional drawing procedures, it becomes apparent that the placement of a score line at the upper surface of the can lid and underneath the intermediate rim is physically impossible. It is axiomatic that a score line so positioned to define the gate must be cut before the drawing operations to form the intermediate underfold rim are completed, because the underfolded rim will lie over this score line. Moreover, since any drawing operation involves stretching of metal, a smooth surfaced sheet is necessary, and even a slight scratch in the sheet being drawn may cause the metal to tear as the drawing proceeds. Thus, a score line which is cut before completing the drawing operation is out of the question. Should the score line be cut in the lid as an intermediate step of the drawing operations, such as after the metal forming the can lid is stretched to form a cup-like cavity but before the cavity is further stretched to form the intermediate underfolded rim beneath the lid, the score line would rupture every time the operation was attempted.

The present invention was conceived and developed with the above considerations in view and comprises, in essence, a gate formed in a panel portion of a can lid beneath an underfolded rim about an opening or aperture in the lid with the outline of this gate being defined by a score line at the upper surface of the gate which lies beneath the intermediate rim. This invention also includes a method for drawing and shaping the lid to form such a gate and includes final steps of compressing, instead of stretching, portions of the sheet metal forming the lid after the score line defining the gate is cut. The compressing of sheet metal is not used in conventional drawing operations and is the antithesis of a drawing operation because a wrinkling of metal cannot be avoided. Nevertheless, it was discovered that the underfolded rim could be partially shaped by drawing to upstand about the gate edge, and after a score line was cut in the lid, the shaping could be completed by folding the rim inwardly and over the score line.

It follows that an object of the invention is to provide, in a can lid having a push-in gate underlying a narrow, intermediate rim about the gate aperture, a score line defining the outline of the gate which is located at the upper surface of the gate and lid underneath the intermediate rim.

Another object of the invention is to provide, in such an arrangement, a simplified and effective mode for sealing a cutthrough or lanced portion of the score line by placing the sealing material in the score line underneath the rim to permit this rim to assist in effectively retaining and confining the sealing material.

Another object of the invention is to provide, in such an arrangement, a simplified method of forming the can lid which permits a score line to be cut in the upper surface of the lid after the drawing and metal stretching steps are completed.

Another object of the invention is to provide in such a can lid having a gate formed beneath an underfolded rim about an opening in the lid, a score line defining the gate within the lid which is cut at the upper surface of the lid and thus avoids any disruption of the coating at the underside of the lid, and which may be cut in a very precise manner, with the depth of the cut being such that the gate can be easily opened, yet will not accidentally open.

Another object of the invention is to provide a gated can lid of the construction set forth above which is economical, reliable and forms a neat appearing product.

With the foregoing and other objects in view, our present invention comprises certain constructions, combinations and arrangements, sequences, operations and steps, all as hereinafter described in detail, defined in the appended claims, and supplemented by the accompanying drawing in which:

Figure 1:
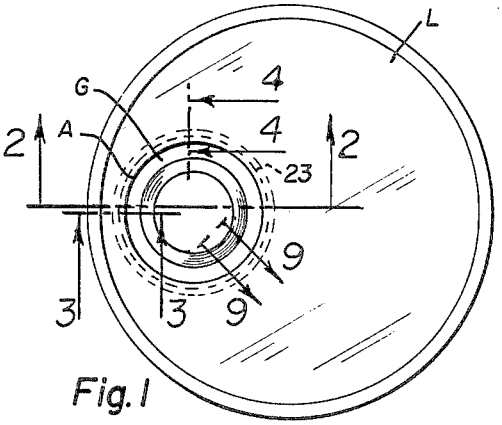
FIG. 1 is a plan view of a can lid having a gate formed therein according to the invention.

Referring now to the embodiment illustrated in the drawing, a portion of the can lid L is drawn and scored to form a gate G near one edge of the lid. The gate G is in a panel portion of the lid underneath an aperture A which is connected to the lid by a narrow rim R extending about this aperture. The inner edge 20 of the rim turns upwardly to connect with the lid L while the outer edge 21 turns downwardly to connect with the panel portion 22 of the lid constituting the gate G. Such a structure may be conventionally formed by drawing operations to form a cup with the wall of the cup becoming the rim portion R. This is followed by coining to increase the size of the panel portion 22 at the bottom of the cup which becomes the gate. Thereafter, folding operations to create the fold of the rim under the lid are followed by cutting a score line at the underside of the panel portion to complete the operation.

Figure 2:
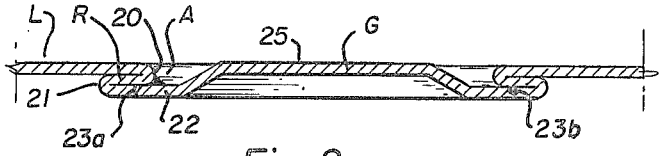
FIG. 2 is a fragmentary sectional detail as taken from the indicated line 2—2 at FIG. 1, but on an enlarged scale and with the thickness of the can lid being exaggerated somewhat to better illustrate the construction of the gate therein.
Figure 3:
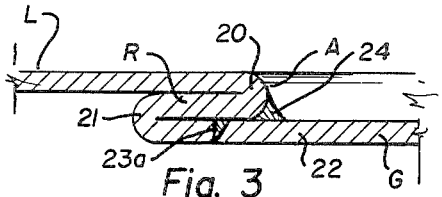
FIG. 3 is a fragmentary sectional detail as taken from the indicated line 3—3 at FIG. 1, but on a greatly enlarged scale to exemplify the score line as being cut through the lid, and indicating further, the use of a sealant at this point.
Figure 4:
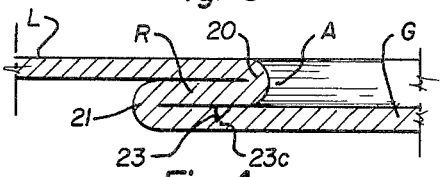
FIG. 4 is a fragmentary sectional detail similar to FIG. 3, but taken at the indicated line 4—4 at FIG. 1 to illustrate a typical point where the score line is not cut through the lid.

In the present invention, a modified sequence of operations, as hereinafter described, permit the score line 23, which defines the outline of the gate G, to be cut in the upper surface of the panel portion 22 forming the gate. This cut will be underneath the rim R as best illustrated at FIGS. 2, 3 and 4. The gate G, shown at FIG. 1, is illustrated as being circular to lie underneath a circular aperture A and this score line at the upper surface of the gate, as shown in broken lines at FIG. 1, is also circular. However, the gate, the aperture and score line may also be shaped otherwise, such as to an ovate form without changing the basic structure.

This score line 23 which will be cut into the surface of the lid by a suitable die may vary in depth at different points about its circular reach. Preferably, the gate will commence to open at a point 23*a* near the edge of the can lid and will hinge at a point 23*b* diametrically opposite therefrom as best illustrated at FIG. 2. Accordingly, the depth of the score cut at the opening point 23*a* may extend completely through the lid to start the opening operation of tearing the lid at this score line. If the cut extends completely through the lid at this point, a suitable sealant 24, such as a selected microcrystalline wax, may be used at this point to fill the score cut to prevent leakage of the contents of the can. If such a sealant is used, it may be applied to the can lid adjacent to the inner edge rim fold 20 as a liquid to flow by capillary action underneath the rim R and into the score cut 23*a* as illustrated at FIG. 3. The remainder of the score cut 23 about the can lid from each side of this opening point 23*a* will extend only partially through the can lid to provide a narrow neck 23*c* between the score cut and the underside of the gate so that the gate will remain integral with the can lid until the gate is pushed downwardly to open the lid. Finally, at the opposite hinging edge 23*b* of the gate, the score cut may be shallow or completely absent so that the gate will hinge downwardly into the can at this point without separation from the lid.

As shown in the drawing, this score cut 23 is completely underneath the rim R and away from the inner edge of the aperture A, so that any ragged edge of metal which may result when the gate is pushed downwardly to be torn at the score line, will not be at a position where it can contact a user's finger should his finger be pushed into the aperture while opening the gate. Instead, the rounded inner edge 20 joining the rim to the lid will be contacted. It is to be noted that this gate G may be formed as a flat surface or the inner portion thereof may be formed as a dome 25 as illustrated at FIG. 2.

Figure 5:
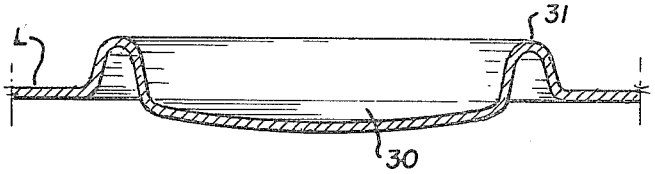
FIGS. 5, 6, 7 and 8 are fragmentary sectional views similar to FIG. 2, but illustrating the principal sequential steps which may occur in the formation of the lid construction shown at FIG. 2.
Figure 10:
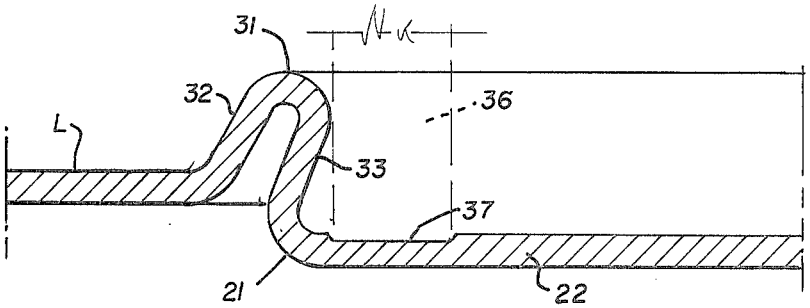
FIG. 10 is a fragmentary sectional detail similar to a portion of the showing at FIG. 7, but on a greatly enlarged scale, and illustrating further, in dotted lines, a die and the manner in which the die may coin and control the thickness of the lid at the portions where a score cut is to be made.

FIGS. 5 14 10 illustrate in a somewhat diagrammatic manner some of the steps for forming a gate G underneath the underfolded rim R and with the score line 23 being at the top surface of the gate portion of the lid. The first operations will involve metal stretching at the panel area where the gate G is to be located. For example, a hat section or cup may be formed and the panel area may be dished as at 30, FIG. 5, to provide an excess of metal to work with. Next, the cup portion of the hat section may be raised to form an upstanding ridge 31.

Figure 6:
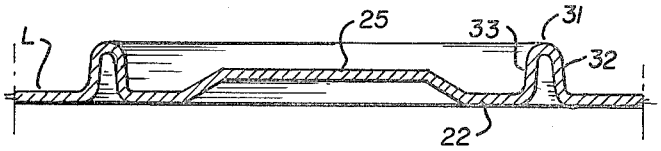

As illustrated at FIG. 6, a further step in the forming operations consists in modifying the shape of the cup 30 to finish the panel portion 22 and form the dome 25 which will be at the center of the gate G. At the same time, the ridge 31 is narrowed by squeezing in the sides 32 and 33 to permit this ridge to upstand above the lid surface as a ring-like unit.

Figure 7:
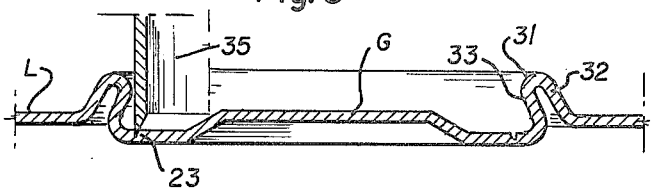

The next steps in the forming operations uses a compressive die to engage the outer side of the ring-shaped ridge 31 to compress and tip this ring-shaped ridge inwardly to commence an inward movement to eventually cause the ridge portion to overlie the panel portion 22. However, when the circular channel ring is tipped inwardly a small amount, the score line 23 is cut by a circular knife 36 as illustrated at FIG. 7. It is to be noted that this score line is at the flat surface of the panel portion 22, and at a location where further flexing and stressing of the metal forming the can lid will not occur when the ridge is tipped over and against this panel.

The circular floor forming this channel may be coined and sized before the score line is cut to provide for a precise thickness of metal wherein the cut is to be made. A coining die 36, shown in broken lines at FIG. 10, can provide a specified thickness of metal so that, thereafter, the knife 35 can cut the score line to a selected depth leaving a precisely controlled residual thickness of metal below the score line, a neck 23C, as shown at FIG. 4. This neck will be ultimately torn; thus, it is desirable to leave a very thin neck 23c so that the tearing force to open the lid is not large. The coining die, in this application, also increases the surface of metal available not only to provide more metal surface to the gate, but also, to assist in producing a slight in-tipping to the channel ring, as best shown at FIG. 10.

Figure 9:
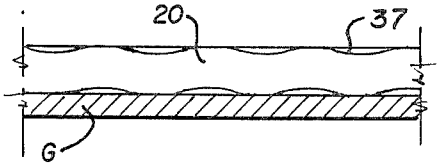
FIG. 9 is a fragmentary sectional detail as taken from the indicated line 9—9 at FIG. 1, but on an enlarged scale, and showing in somewhat exaggerated manner a ripple pattern in the overfold of the lid and rim portion above the gate when the same is formed according to the present invention.
Figure 8:
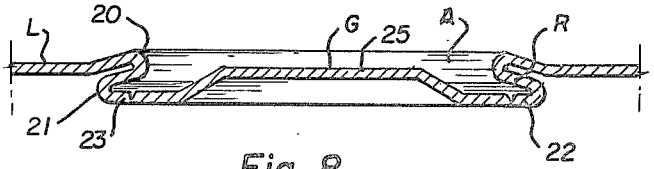

Further steps to complete the can lid with the gate therein are performed by compression to fold the channel ring 31 inwardly and downwardly to complete the forming of the gate, as partially illustrated at FIG. 8, so that the gate will lie against the circular floor 22 as illustrated at FIG. 2. This final operation will result in compressing the channel ring inwardly and downwardly in a manner which is contrary to a conventional drawing operation since the metal in this ring will be compressed instead of being drawn, and the compression will be the only operation occurring after the score line is cut and in a region away from and not affecting the score line. In compressing a thin metal ring such as is formed in a can lid sheet having a thickness of only a few thousandths of an inch, it is possible that the operation will cause the inside edge of the ring to buckle. Nevertheless, under the influence of a properly formed set of dies, such buckling action will be in a comparatively uniform manner as diagrammatically illustrated as a ripple 37 at FIG. 9. This rippling 37 will actually be minimized by the pressure of the dies pushing the circular channel in its final position and even, if noticeable on the final can lid, the ripple will not be objectionable or significant.

We have now described our invention in considerable detail. However, it is obvious that others skilled in the art can build and devise alternate and equivalent constructions which are nevertheless within the spirit and scope of our invention. Hence, we desire that our protection be limited not by the constructions illustrated and described, but only by the proper scope of the appended claims.

What is claimed is:

1. The method of forming a can lid blank having a push-down gate in a panel portion of the lid below an aperture in the lid, with a narrow spacing rim underfolded about the aperture whose outward edge joins with the panel portion therebelow, and including the steps of:

a. drawing a cup downwardly in the lid blank having a bottom area approximating the aforesaid panel portion;

b. drawing a ridge upwardly from the lid blank whose inner wall forms the wall of the aforesaid cup;

c. forming the aforesaid panel portion in the bottom of the cup;

d. cutting a disruptible score line in the formed panel portion adjacent to the ridge to define the outline of the gate therein; and e. folding the ridge inwardly and downwardly to overlie the score line and form the aforesaid aperture.

2. The method defined in claim 1, wherein:

the walls of the ridge are pulled together and tipped inwardly slightly prior to the score cutting step.

3. The method defined in claim 1, including the step of:

forming a dome in the panel prior to cutting the score line.

4. The method of forming a can lid blank having a push-down gate in a panel portion of the lid below an aperture in the lid, with a narrow spacing rim underfolded about the aperture whose outward edge joins with the panel portion therebelow, and including the steps of: drawing a cup downwardly in the lid blank having a bottom area approximating the aforesaid panel portion in the bottom of the cup; cutting a disruptible scoreline in the formed panel portion adjacent to the ridge to define the outline of the gate therein, the panel portion at the scoreline being coined prior to the cutting thereof whereby to establish a uniform panel thickness at the score cut; and folding the ridge inwardly and downwardly to overlie the scoreline and form the aforesaid aperture.

5. The method defined in claim 4, wherein:

the panel portion is coined in the region of the score line, at each side, thereof, whereby to increase the metal surface available to the panel and predispose the ridge to tip towards the panel to simplify the subsequent compression operation.

* * * * *